US005553819A

United States Patent [19]

Smajdek

[11] Patent Number: 5,553,819

[45] Date of Patent: Sep. 10, 1996

[54] DEVICE FOR HOLDING FLEXIBLE TUBE DISPENSERS

[76] Inventor: James A. Smajdek, P.O. Box 184, Spring Branch, Tex. 78070

[21] Appl. No.: 480,513

[22] Filed: Jun. 13, 1995

Related U.S. Application Data

[63] Continuation of Ser. No. 45,367, Apr. 9, 1993, abandoned, which is a continuation-in-part of Ser. No. 534,730, Jun. 7, 1990, abandoned, which is a continuation of Ser. No. 274,397, Nov. 21, 1988, abandoned.

[51] Int. Cl.[6] ..... B65D 35/56

[52] U.S. Cl. ..... 248/108

[58] Field of Search ..... 248/360, 108, 248/311.3; 222/92, 93, 103, 105; 24/570, 571, 563, 555, 545, 546

[56] References Cited

U.S. PATENT DOCUMENTS

| | | | |
|---|---|---|---|
| 2,390,314 | 12/1945 | Massey | 222/103 |
| 2,474,080 | 6/1949 | Witte | 248/108 |
| 2,656,069 | 10/1953 | Fogarty et al. | 222/103 |
| 3,269,603 | 8/1966 | Reimann | 222/103 |
| 3,446,468 | 5/1969 | Sakwa | 248/108 |
| 3,458,110 | 7/1969 | Goldman | 24/555 X |
| 4,019,656 | 4/1977 | Spears | 222/103 |
| 4,332,060 | 6/1982 | Sato | 24/545 X |
| 4,976,380 | 12/1990 | Schuckmann | 222/103 |
| 5,222,629 | 6/1993 | Tal | 222/103 |

*Primary Examiner*—David M. Purol
*Attorney, Agent, or Firm*—Gunn, Lee & Miller, P.C.

[57] ABSTRACT

A combination of a relatively rigid retaining clip and a squeezable product dispensing tube, the tube having a base and side walls forming a chamber for containing a flattened and folded portion of the tube, at least the side walls having radiused or chamfered edges and slick surfaces and exaggerated flared wall portions forming deflectionary side entrances, whereby the elastomeric side walls of the tube may be slidably removed from and replaced in the clip multiple times without damage to the tube as the side walls are flattened and folded into increasingly larger folds. A gap between the top ends of the clip are sized to restrict, but not fully seal, the rearward flow of product in the tube when dispensing pressure is applied thereby causing the product to be urged forward and out the tube dispensing orifice.

6 Claims, 2 Drawing Sheets

DEVICE FOR HOLDING FLEXIBLE TUBE DISPENSERS

This is a continuation application to U.S. patent application Ser. No. 08/045,367, filed Apr. 9, 1993, now abandoned, which was a continuation-in-part application to U.S. patent application Ser. No. 07/534,730, filed Jun. 7, 1990, now abandoned, which was a continuation of U.S. patent application Ser. No. 274,397, filed Nov. 21, 1988, and now abandoned.

BACKGROUND OF THE INVENTION

The invention relates to a device for holding flexible tube dispensers, such as those containing toothpaste, glue or ointment.

A variety of products are distributed in squeezable tube dispensers whereby the product contained therein is extruded from the dispenser by manual dispensing pressure. The use of such tubes has always been hampered by the tendency of the product contained therein to move in both longitudinal directions within the tube, i.e., both rearward away from the dispenser opening and forward toward the dispenser outlet opening when pressure is applied to the tube. This problem has been aggravated by the use, in recent times, of plastic and other elastomeric compositions or substances to form the tubes. Such substances have a very high elastic limit and such tubes, even if carefully flattened and folded or rolled, tend to gradually unfold allowing product contained therein to easily flow in both directions when dispensing pressure is applied. It is not necessary that a seal be formed between the rolled and unrolled portions when the tube is folded or rolled but merely that there be a sufficient restriction created to cause resistance to the rearward flow of product during dispensing of the product.

A variety of devices have been proposed for use with collapsible tubes. In general, such devices have frequently proposed a combination of an exterior housing and turning key, whereby a key was attached to one end of the tube and the combination of the tube and key were inserted into the housing. Such devices are shown, for example, in U.S. Pat. No. 3,910,460 to Hausmann and U.S. Pat. No. 4,576,314 to Elias. A clamp device has also been proposed by Wright, U.S. Pat. No. 4,159,787.

Further, U.S. Pat. No. 3,458,110 to A. K. Goldman teaches the use of a clip in combination with a reclosable container to seal the container after it is opened. The Goldman closure clip is designed specifically to tightly reseal a "container of paper board or the like having a gable top with a central laminar rib across the top." The Goldman clip is not intended for removal from the container once it is initially attached or for use with rolled or folded plastic or elastomeric substances which tend to gradually unfold. It is intended to slide along the rib and tightly seal the closure. Further yet, since the device of Goldman needs to create a tightly sealed closure, the ends of the clip are merely slit (not gapped) and the resilient nature of the materials urge the slit toward closure. There is no teaching that the clip may be removed from a particular container, or that once removed, the clip may be reused or reattached to the particular container.

SUMMARY OF THE INVENTION

The present invention comprises a reusable clip without moving parts which effectively permits a user to easily and quickly remove the clip from a dispensing tube, shorten the tube by flattening and rolling it, and replace the clip. The clip is specifically configured so that it may be removed and replaced multiple times without damage to or puncturing of the walls of the dispensing tube. The clip prevents the folded or rolled portion of the dispensing tube from either unfolding or being further folded while the tube is in the clip. When dispensing pressure is applied to the tube, resistance to the rearward flow of product in the tube is created by an appropriate sized gap between the clip top ends when the roll or fold is small and by the roll folding on itself when the roll is large.

Further, either or both side openings of the clip may be provided with exaggerated flared wall portions along the entire opening or tube entrance. These flared wall portions create tapering ramps which enable a large roll of tubing to be easily inserted into the clip without damaging or puncturing the tubing material. The outer edges of the flared wall portions are provided with a smooth, hemispherical radiused curvature to further facilitate insertion of rolled tubes into the clip. The clip may be provided with a generally flattened bottom surface so that the clip and dispensing tube may be stored upright, or with an open hook so that the clip and tube may be hung from an appropriate fixture.

With the forgoing in mind, it is the principal object of the present invention to provide a clip for holding squeezable product dispensing tubes which can be removed from and replaced on a tube multiple times without injury to the tube.

It is an object of the present invention to provide a deflectionary side-entry clip adapted to accommodate multiple folds of an elastomeric tube containing squeezable product having an end gap portion creating a resistance to rearward flow of product during the application of dispensing pressure to the tube when the tube roll is small.

A further object of the present invention is to provide a tube clip having no moving parts.

A further primary object of the present invention is to provide a clip for product dispensing tubes which prevents the rolling and unrolling of a dispensing tube so long as the tube is held in the clip. Another object of the invention is to provide a clip for holding squeezable product dispensing tubes, having convenient means for storing the clip and tube combination.

These and other objects and features of the present invention will be apparent from the detailed description taken with reference to the accompanying drawings.

DETAILED DESCRIPTION OF THE PREFERRED EMBODIMENT

Figure 1:
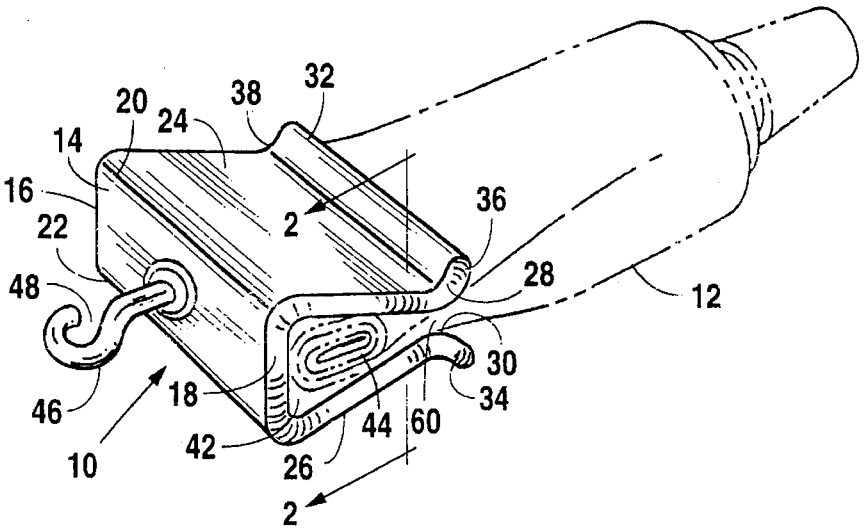
FIG. 1 is a perspective view of a clip of the present invention together with a squeezable product dispensing tube, shown in phantom outline.

Reference is now made to the figures. A clip, generally designated 10 in FIG. 1, retains a squeezable product dispensing tube 12, which has been previously manually flattened and folded or rolled, in such a way as to prevent the tube 12 from unfolding. The clip 10 comprises a substantially planar base portion 14. The base 14 comprises two exposed side edges 16, 18 in spaced parallel relationship to each other, and corners 20, 22 which are in spaced parallel relationship to each other and at right angles to the exposed edges 16, 18. The clip 10 further comprises two substantially similar side walls 24, 26 which are connected to the base 14 at the corners 20, 22, respectively. From the base 14, the two substantially planar walls 24, 26 slope toward each other forming an increasingly narrow space therebetween. The distance between the two walls reaches a minimum gap 60 at outward bends 28, 30 on the respective side walls 24, 26. The walls 24, 26 then diverge from one another to form lips 32, 34, respectively. The minimum gap 60 is sufficiently large to accommodate a flattened portion of the squeezable tube without compressing the side walls of the tube against each other or fully sealing the rearward flow of product in the tube when dispensing force is applied to the tube.

The gap 60 remains open when the tube is removed from the clip so that after the tube is further rolled, the clip may be slid over the flattened portion of the tube without damaging or puncturing the tube material. It must be understood that the gap must not be so large that when dispensing pressure is applied to the tube when the tube is in the clip that there is less restriction to rearward product flow in the tube than there is to forward product flow out of the tube dispensing orifice. The base 14, walls 24, 26 and lips 32, 34 are all substantially rectangular in form.

Figure 2:
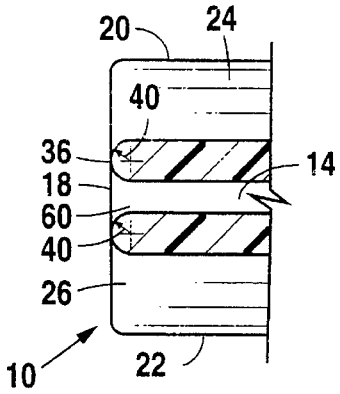
FIG. 2 is a partial cross sectional view of the clip shown in FIG. 1 taken along Line 2—2.

The clip 10 has side edges 36, 38 which are chamfered or radiused. This construction can best be seen in FIG. 2, which shows a partial cross section of the clip 10 taken along line 2—2 at a point where the side walls 24, 26 are closest together forming gap 60. The edge 36 is formed in a hemispherical shape, having a radius 40. The radiused edge 36 is relatively easily manufactured, and must have a sufficient slope so that a squeezable product dispensing tube may be slipped between the side walls 24, 26 without damaging the tube. In addition, the clip 10 is manufactured of a substance having a low coefficient of friction, such as polyethylene, so that a flattened, plastic or elastomeric squeezable tube can be slid between the walls 24, 26 into gap 60 with little force and without damage to the tube 12.

The clip 10 is preferably formed of a fairly rigid substance, such as polyethylene, so that the clip 10 resists deformation. Being relatively rigid as compared to the squeezable tube 12, the walls 24, 26 and the base 14 form an elongated chamber 42. When a folded or rolled portion 44 of the tube 12 is within the chamber 42, it cannot be further folded or unfolded without removing the tube 12 from the clip 10.

The clip 10 may further comprise an open hook 46 affixed to the base 14. The hook 46 has a gap 48 which permits a clip 10 and tube 12 to be hung from a bar or other fixture with other clips and tubes whereby each clip and tube combination may be removed from the fixture for use and replaced in any order without disturbing the other clips and tubes.

Figure 3:
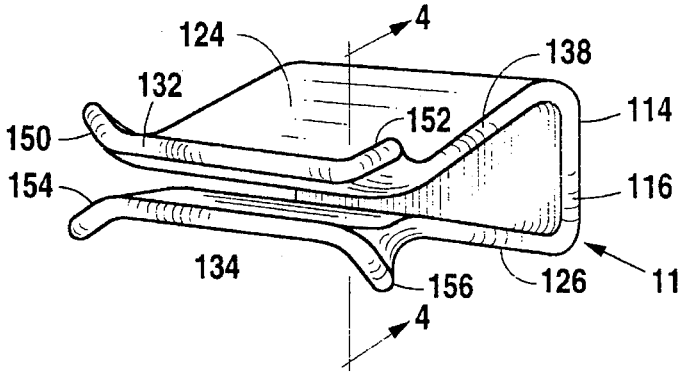
FIG. 3 is a perspective view of an alternative embodiment of a clip made according to the principles of the present invention.
Figure 4:
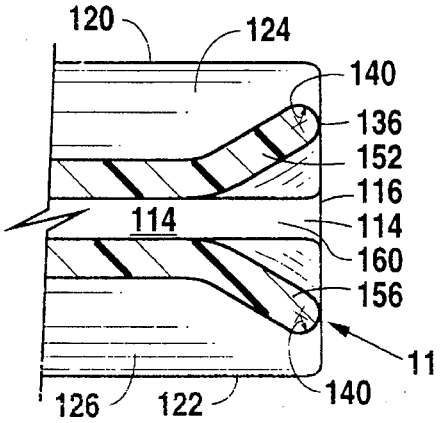
FIG. 4 is a partial cross sectional view taken along Line 4—4 of FIG. 3.

A second embodiment of the present invention is illustrated in FIGS. 3 and 4. The walls 124, 126 and lips 132,134 of the clip 11 further comprise flared end edges 150, 152, 154, 156. As shown in FIGS. 3 and 4, the flared end edges, such as edges 152, 156, present a wider end opening toward the outside of the clip so that the tube 12 may be more easily slid into the clip 11. The angle of the flared edges 152,156 present tapering or inclined surfaces to the tube 12, which tends to urge the tube 12 between the walls 124, 122 and into gap 160. The risk of damaging the tube 12 is thereby minimized and the ease with which the tube 12 can be reinserted in the clip 11 is increased.

Figure 5:
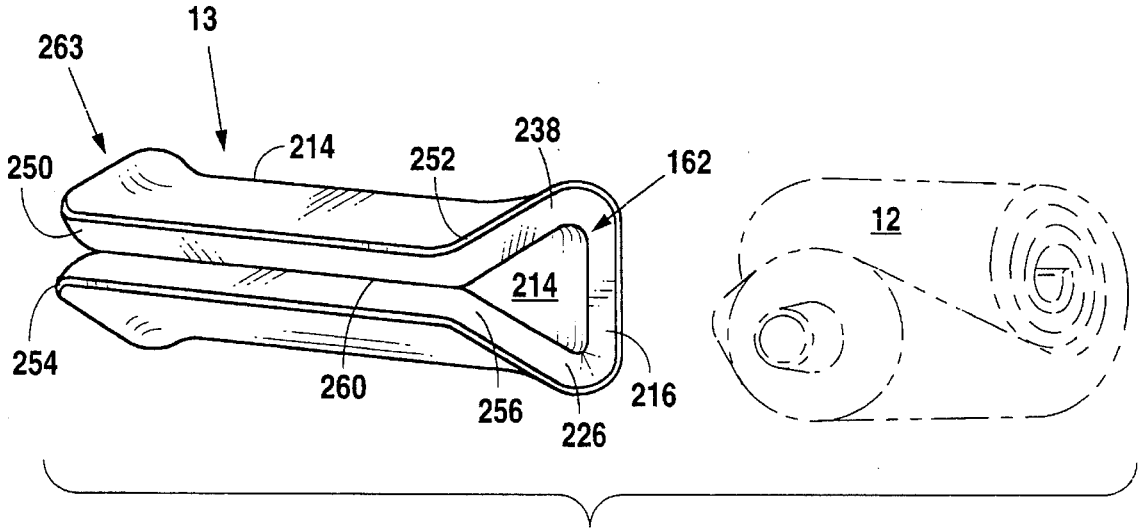
FIG. 5 illustrates a perspective view of an alternative embodiment of the present invention with both side openings having exaggerated flared wall portions forming tapering entrances for large rolled tubes.

A third embodiment of the present invention is illustrated in FIG. 5. A deflectionary side entrance 262 is formed by providing exaggerated flared wall portions 216, 226 and 238 along the entire first side opening of the clip 13. The flared wall portions result in this funnel shaped opening or entrance 262 into the chamber 242 formed in the chip 14 as discussed above with chip 10. On the opposite side of the clip 13, a second deflectionary side entrance 263 is also provided. Entrance 263 also has exaggerated flared wall portions along this entire second side opening of clip 13. Thus the second funnel shaped entrance 263 is provided into chamber 242. The cooperation of the deflectionary side entrances with the radiused, hemispherical edges of the side walls and end walls enable a large roll of tube to be inserted into the chamber 242 formed by the three walls with the flattened tube portion passing through gap 260 without damaging the tube material.

When a large roll or fold of tube is presented to entrance 262, the leading roll edge engages the inside surfaces of flared wall portions and gradually and gently urges against the three walls. This allows the roll to be compressed into a tighter roll or fold with less likelihood of the roll unwinding. The gap 260 is gradually opened by the insertion of the elastomeric tube urging against the inside surfaces of the flared wall portions, but now rearward flow of product upon the application of dispensing force is restricted by the folding over of the tube upon itself. There is no complete sealing of the rearward flow by the roll, but sufficient resistance to cause the product to take the "path of least resistance" out the tube dispensing orifice when dispensing pressure is applied. No sharp edges or abutments are confronted by the elastomeric tube and there is no puncturing or damage to the tube material.

Again, the gap 260 is sized to accommodate the flattened but unrolled or unfolded tube portion while not compressing the side walls of the tube against each other fully sealing against rearward product flow when dispensing pressure is applied to the tube. The gap is sized to restrict rearward flow and allow product to flow out the tube dispensing orifice without tightly urging against the side walls of the tube.

Figure 6:
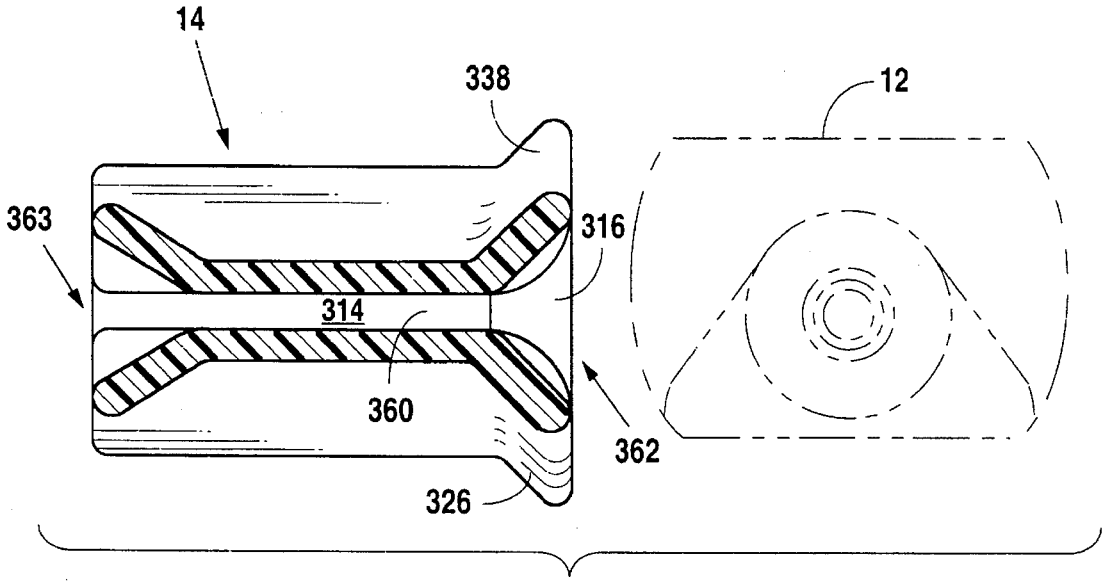
FIG. 6 illustrates a partial cross-sectional top view of an embodiment of the present invention having a combination of side entrances; one side opening having exaggerated flared wall portions forming tapering entrances for larger rolled tubes.

FIG. 6 illustrates yet another embodiment of the present invention. A partial cross-sectional, top view of clip 14 is shown with one funnel shaped deflectionary side entrance 362 made up of flared wall portions 338, 326 and 316, similar to those discussed regarding FIG. 5 above. However, the opposite side of clip 14 has a side entrance 363 similar to the one described in FIGS. 3 and 4. In the embodiment of FIG. 6, the user may find it more convenient to insert a rolled or folded tube, having only a small roll or fold, into side entrance 363. As the product in the tube is reduced, and the rolled or folded portion becomes larger, the user may find it easier to insert the large rolled tube into deflectionary side entrance 362.

The gap 360 between the ends is forced open wider by the roll pressing against the inside surfaces of the flared side wall portions 338 and 326 as the rolled tube is inserted into clip 14. However, the gap opening is no longer as critical to the restriction of the rearward flow of product when dispensing force is applied. This is because of restrictive or resistive force created by the tube being folded over on itself and being unable to unwind because of its being compressed by the inside side walls of the chamber formed in the clip.

The invention may be embodied in other specific forms without departing from the spirit or essential characteristics thereof. The present embodiments are therefore considered in all respects all illustrative and not restrictive. The scope of the invention being indicated by the appended claims rather than by the foregoing description, and all changes which come within the meaning and range of equivalency of claims are therefore intended to be embraced therein.

What is claimed and desired to be secured by United States Letters Patent is:

1. A combination of a removable and reusable retaining clip and an elongated dispensing tube for containing a squeezable product, said tube comprising:

elastomeric opposing side walls adaptable to be flattened and folded into increasingly larger folds until substantially the entire length of said tube may be flattened and folded, said retaining clip comprising:

a substantially rigid base;

two substantially rigid side walls connected to said base at opposing edges thereof, each wall and said base forming a substantially rigid corner at the place of connection, and each said wall having an end spaced away from said corner where said wall is connected to said base to a minimum separation distance whereby a gap is formed between said ends of said two side walls, said minimum separation distance being of sufficient dimension to accommodate a flattened portion of said squeezable product dispensing tube and to restrict the rearward flow of said product in said tube without fully compressing said tube side walls against each other, said walls and base forming an elongated chamber for enclosing the entire width of a flattened and folded portion of said product dispensing tube on three sides thereof, whereby said flattened and folded portion of said tube is prevented from folding or unfolding, said walls and base further forming two side openings for receiving said flattened and folded portion of said squeezable tube, said chamber sized to enclose substantially said entire length of said product dispensing tube when said substantial length of said tube is flattened and folded; and a lip connected to each said side wall at said end thereof, said lips diverging away from each other from said minimum separation distance, said walls and lips further comprising hemispherically shaped, radiused edges extending the outer entire edge of said side openings, said radiused edges sloped sufficiently to cooperate with said increasingly larger folds of said flattened and folded portion of said product dispensing tube to enable said dispensing tube to be inserted and removed from said gap without damaging said tube, said squeezable product capable of being dispensed when said entire width of said flattened and folded portion is enclosed with said chamber.

2. A clip according to claim 1 wherein each of said side walls and lips further comprise a surface having a low coefficient of friction substantially adjacent to said chamber for slidable receiving said flattened portion of said tube.

3. A clip according to claim 2 wherein said surfaces comprise polyethylene surfaces.

4. A clip according to claim 1 further comprising means attached to said base for hanging said clip and tube combination from a bar or other fixture.

5. A clip according to claim 4 wherein said hanging means comprises and open hook.

6. A combination of a removable and reusable retaining clip and an elongated dispensing tube for containing a squeezable product, said tube comprising:

elastomeric opposing side walls adaptable to be flattened and folded into increasingly larger folds until substantially the entire length of said tube may be flattened and folded, said retaining clip comprising: a substantially rigid base;

two substantially rigid side walls connected to said base at opposing edges thereof, each wall and said base forming a substantially rigid corner at the place of connection, and each said wall having an end spaced away from said corner where said wall is connected to said base to a minimum separation distance whereby a gap is formed between said ends of said two side walls, said minimum separation distance being of sufficient dimension to accommodate a flattened portion of said squeezable product dispensing tube and to restrict the rearward flow of said product in said tube without fully compressing said tube side walls against each other, said walls and base forming an elongated chamber for enclosing the entire width of a flattened and folded portion of said product dispensing tube on three sides thereof, whereby said flattened and folded portion of said tube is prevented from folding or unfolding, said walls and base further forming two side openings for receiving said flattened and folded portion of said squeezable tube, at least one of said side openings having exaggerated flared wall portions along the entire outer edges of said opening forming a tapered, sloping entrance for increasingly larger folds of said flattened and folded portion of said squeezable tube, said chamber sized to enclose substantially said entire length of said product dispensing tube when said substantial length of said tube is flattened and folded; and a lip connected to each said side wall at said end thereof, said lips diverging away from each other from said minimum separation distance, said walls and lips further comprising hemispherically shaped, radiused edges extending the outer entire edge of said side openings, said radiused edges sloped sufficiently to cooperate with said exaggerated, flared wall portions and with said increasingly larger folds of said flattened and folded portion of said product dispensing tube to enable said dispensing tube to be inserted and removed from said gap without damaging said tube, said squeezable product capable of being dispensed when said entire width of said flattened and folded portion is enclosed within said chamber.

* * * * *